US007344003B2

(12) United States Patent
Kimura et al.

(10) Patent No.: US 7,344,003 B2
(45) Date of Patent: Mar. 18, 2008

(54) ELEVATOR CONTROL DEVICE FOR PLURAL TRACTION UNITS

(75) Inventors: Yasuki Kimura, Tokyo (JP); Naoki Hashiguchi, Tokyo (JP); Satoshi Suzuki, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 623 days.

(21) Appl. No.: 10/898,237

(22) Filed: Jul. 26, 2004

(65) Prior Publication Data

US 2005/0217945 A1 Oct. 6, 2005

(30) Foreign Application Priority Data

Mar. 31, 2004 (JP) ..... 2004-102930

(51) Int. Cl.
*B66B 11/08* (2006.01)

(52) U.S. Cl. ..... 187/256; 318/85

(58) Field of Classification Search ..... 187/247, 187/248, 293, 296, 297, 250, 251, 254, 256; 318/34, 66–70, 85
See application file for complete search history.

(56) References Cited

U.S. PATENT DOCUMENTS

| | | | | |
|---|---|---|---|---|
| 3,789,280 A | | 1/1974 | Oldfield | |
| 3,886,417 A | * | 5/1975 | Niwa | 318/7 |
| 4,042,069 A | | 8/1977 | Ohira et al. | |
| 4,617,498 A | * | 10/1986 | Ruppert | 318/85 |
| 5,625,262 A | * | 4/1997 | Lapota | 318/71 |
| 6,193,016 B1 | * | 2/2001 | Hollowell et al. | 187/250 |
| 6,193,017 B1 | * | 2/2001 | Koster | 187/258 |
| 6,634,461 B1 | * | 10/2003 | Baker | 187/247 |
| 6,956,339 B1 | * | 10/2005 | Kureck et al. | 318/85 |
| 6,964,322 B2 | * | 11/2005 | Green et al. | 187/285 |

FOREIGN PATENT DOCUMENTS

| | | |
|---|---|---|
| DE | 92 05 254.1 | 7/1992 |
| EP | 1 006 071 | 6/2000 |
| GB | 2 118 130 | 10/1983 |
| JP | 6-64863 | 3/1994 |
| JP | 7-25553 | 1/1995 |
| JP | 2002-145544 | 5/2002 |

* cited by examiner

*Primary Examiner*—Jonathan Salata
(74) *Attorney, Agent, or Firm*—Buchanan Ingersoll & Rooney PC

(57) ABSTRACT

An elevator control device for controllably driving multiple traction units includes position sensors and current supplies. Each of the current supplies includes a position controller for generating a speed command for the corresponding traction unit based on input difference between a common position command for the traction units and a feedback signal derived from an output of the pertinent position sensor, a speed controller for generating a current command for the corresponding traction unit based on an input difference between the speed command generated by the position controller and a feedback signal obtained by differentiating the output of the pertinent position sensor, and a current controller for supplying an electric current to the corresponding traction unit based on the current command generated by the speed controller.

15 Claims, 16 Drawing Sheets

ELEVATOR CONTROL DEVICE FOR PLURAL TRACTION UNITS

BACKGROUND OF THE INVENTION

1. Field of the Invention

The present invention relates to an elevator control device for controlling raise/lower motions of a load-carrying elevator car by operating hoist ropes, each of which is connected to the car at one end and a counterweight at the other end, by driving a plurality of traction units.

2. Description of the Background Art

Conventional elevator control devices for high-speed, high-capacity elevators are designed to raise and lower an elevator car by means of a single traction unit. These conventional systems used to have such a problem that it was necessary to manufacture a high-capacity traction unit which would require a large installation space.

One previous approach directed to the resolution of this problem is found in Japanese Laid-open Patent Publication No. 2002-145544. According to the Publication, an elevator is provided with a main traction unit, auxiliary traction units and a control device which monitors operating status of the elevator. If the control device senses that a great force is needed for hoisting the elevator car, the control device actuates one or more auxiliary traction units to provide extra traction forces to aid the main traction unit.

Each of the auxiliary traction units has an interlock device for regulating transmission of a driving force from an electric motor of the main traction unit to a deflector sheave of the auxiliary traction unit by slip action to control the rotating speed and torque imparted from the electric motor to the deflector sheave.

The aforementioned system (Publication No. 2002-145544) employs the mechanical interlock device which utilizes the slip action for transmission of power to regulate the driving force transmitted from the main traction unit to the auxiliary traction units. The conventional elevator control device thus constructed has poor response characteristics and operational instability, as well as inadequate serviceability. Furthermore, there can arise relative position and speed errors among the main traction unit and the multiple auxiliary traction units due to differences in the amount of stretching of ropes caused by an imbalance of tensile forces acting on such ropes as main ropes and compensating ropes mounted on the individual traction units. This conventional mechanical system poses a problem that it is difficult to move the elevator car up and down in a stable fashion.

SUMMARY OF THE INVENTION

The present invention is intended to solve the aforementioned problems of the prior art. Accordingly, it is an object of the invention to provide an elevator control device capable of ensuring stable running of an elevator by precisely synchronizing the working of multiple traction units. It is another object of the invention to provide an elevator control device which makes it possible to hold an elevator car in a fixed position in a reliable fashion while the elevator car is lifted up and down.

According to the invention, an elevator control device for controlling up-down movements of a load-carrying car by driving a plurality of traction units which haul a hoist rope interconnecting the car and a counterbalance includes position sensors disposed at the traction units for detecting car position by sensing positions of the individual traction units, and current supplies for supplying electric currents to the individual traction units in which each of the current supplies generates the electric current based on an input difference between a common position command for the traction units and a feedback signal derived from an output of the position sensor disposed at the corresponding traction unit.

The elevator control device thus constructed can synchronize a plurality of traction units and ensure stable running of an elevator in a reliable fashion by compensating for position and speed errors caused by stretching of hoist ropes, for instance.

These and other objects, features and advantages of the invention will become more apparent upon reading the following detailed description along with the accompanying drawings.

DESCRIPTION OF THE PREFERRED EMBODIMENTS

First, traction-type elevator systems which can employ elevator control devices of the invention are described with reference to FIGS. 1 and 2.

Figure 1:
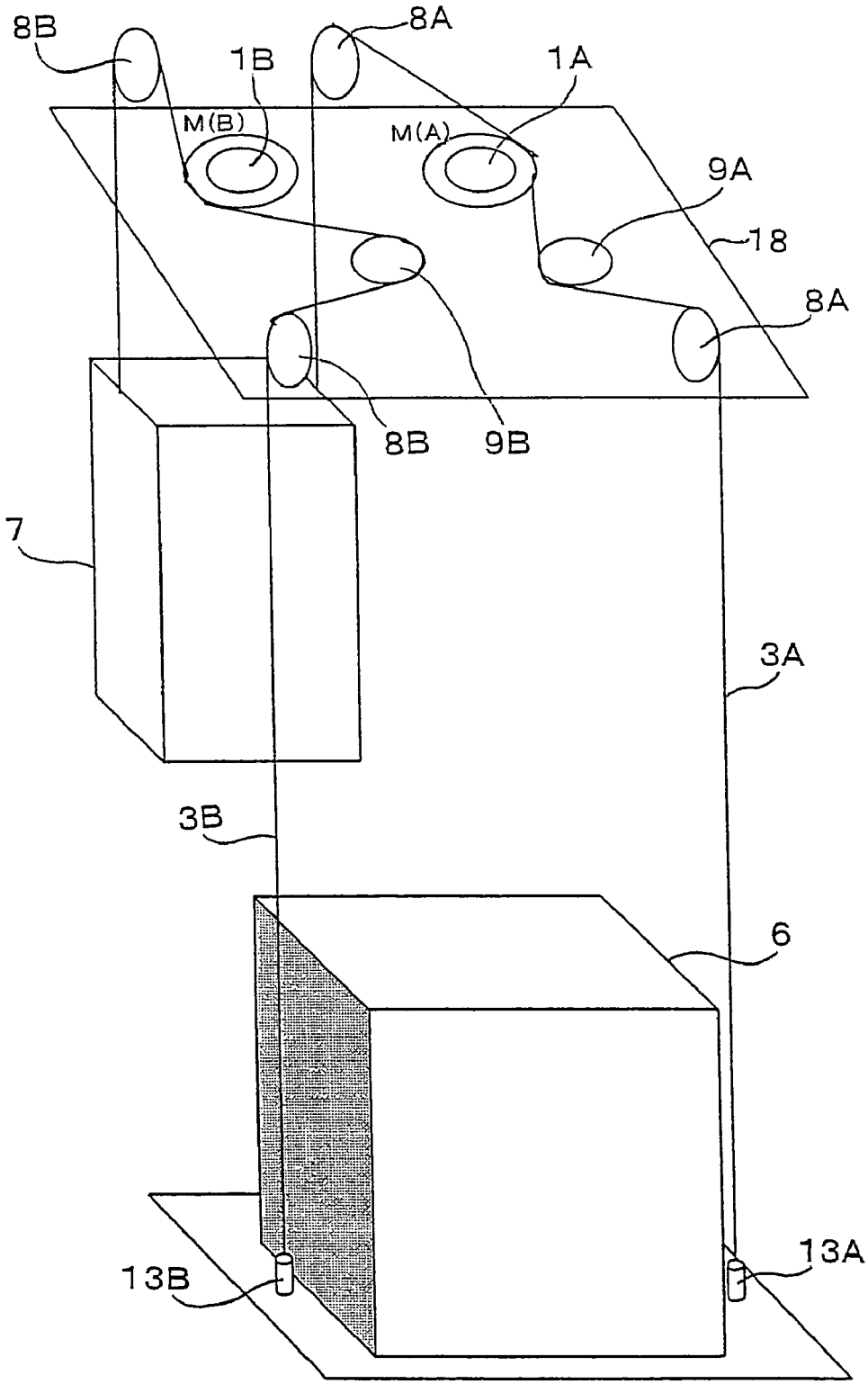
FIG. 1 is a schematic diagram showing the construction of an elevator system to which a control device of the invention is applicable.

FIG. 1 is a schematic diagram showing the general construction of one example of the elevator systems of the invention provided with two traction units 1A, 1B over which two hoist ropes 3A, 3B are mounted, respectively, to lift up and down an elevator car 6. As shown in FIG. 1, one end of each of the two ropes 3A, 3B is connected to a counterbalance 7 while the other end is connected to the car 6 which carries load, such as passengers or freight. The rope 3A is driven by the traction unit 1A which is attached to a supporting base 18 installed as an integral part of a building. More specifically, the rope 3A is wound over a drive sheave which is fixedly connected to a rotor of an electric motor (synchronous motor) which constitutes part of the traction unit 1A. Rotary motion of the electric motor of the traction unit 1A is transmitted to the rope 3A via the drive sheave to lift the car 6 up and down. Similarly, the rope 3B is hauled by a drive sheave which is fixedly connected to a rotor of an electric motor (synchronous motor) of the traction unit 1B.

Overhead sheaves 8A, 8B are grooved pulley wheels which are attached to the supporting base 18 in such a way that their shafts are held in a horizontal position. Driven to rotate as the ropes 3A, 3B run, these overhead sheaves 8A, 8B set hanging positions of the car 6 and the counterbalance 7. Deflector sheaves 9A, 9B are grooved pulley wheels which are attached to the supporting base 18 in such a way that their shafts are held parallel to shafts of the traction units 1A, 1B. Driven to rotate as the ropes 3A, 3B run, these deflector sheaves 9A, 9B serve to maintain an appropriate contact angle between the traction units 1A, 1B and the ropes 3A, 3B, respectively. Weighing units 13A, 13B, which will be later described in detail, detect the amounts of loads, or weights, carried by the ropes 3A, 3B, respectively.

Figure 2:
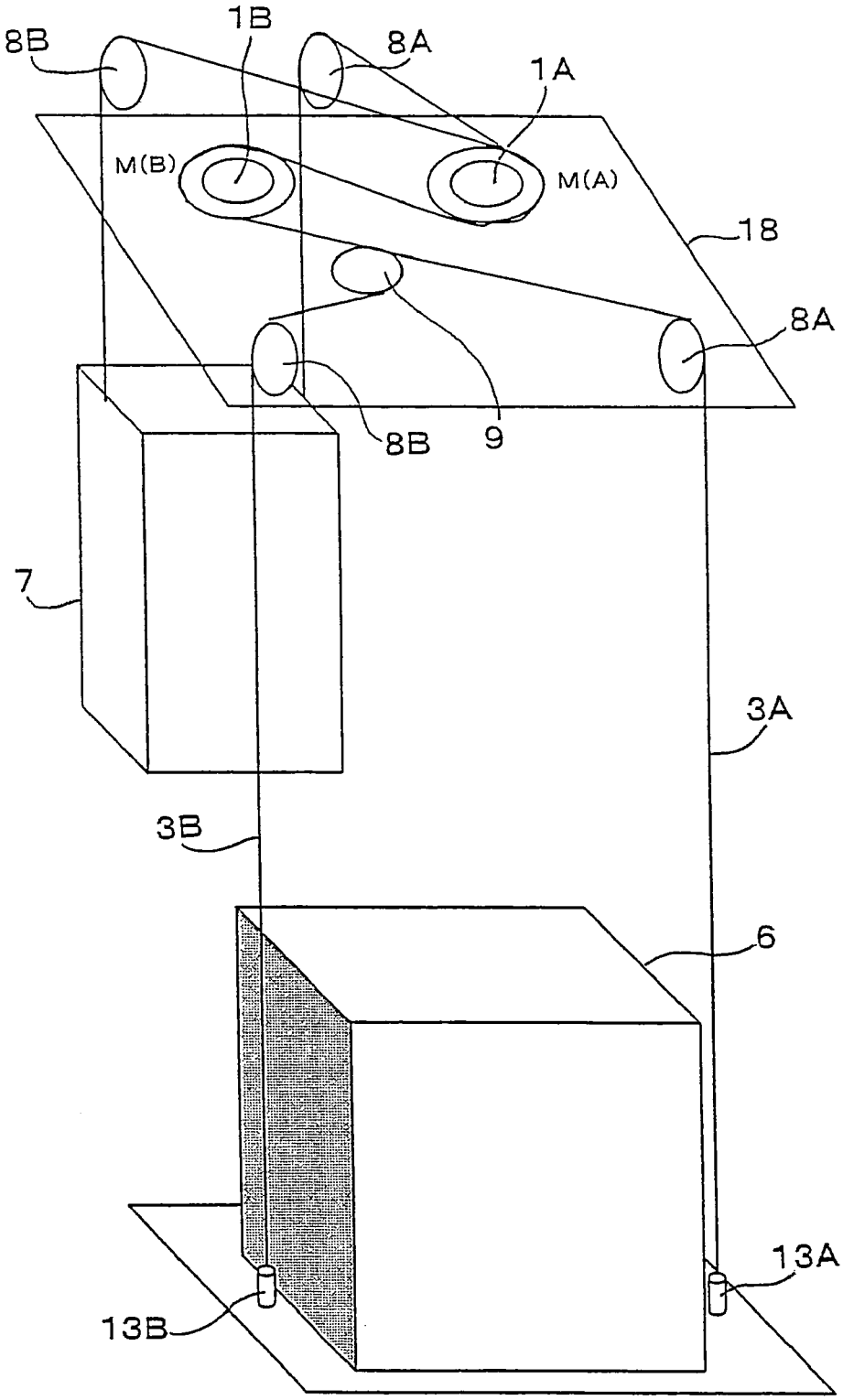
FIG. 2 is a schematic diagram showing the construction of another elevator system to which the control device of the invention is applicable.

FIG. 2 is a schematic diagram showing the general construction of another example of the traction-type elevator systems of the invention. The elevator system of FIG. 2 differs from the elevator system of FIG. 1 in that two ropes 3A, 3B are run side by side at the top of a supporting base 18 and parallel-running portions of the ropes 3A, 3B are hauled together by traction units 1A, 1B. Needless to say, the two traction units 1A, 1B must be run in precise synchronism with each other to realize smooth operation, so that the following elevator control devices constituting principal part of the invention can be effectively adopted.

It is to be understood that the elevator control devices described hereunder are similarly applicable to either of the two examples of the elevator systems shown in FIGS. 1 and 2 unless otherwise mentioned specifically.

First Embodiment

Figure 3:
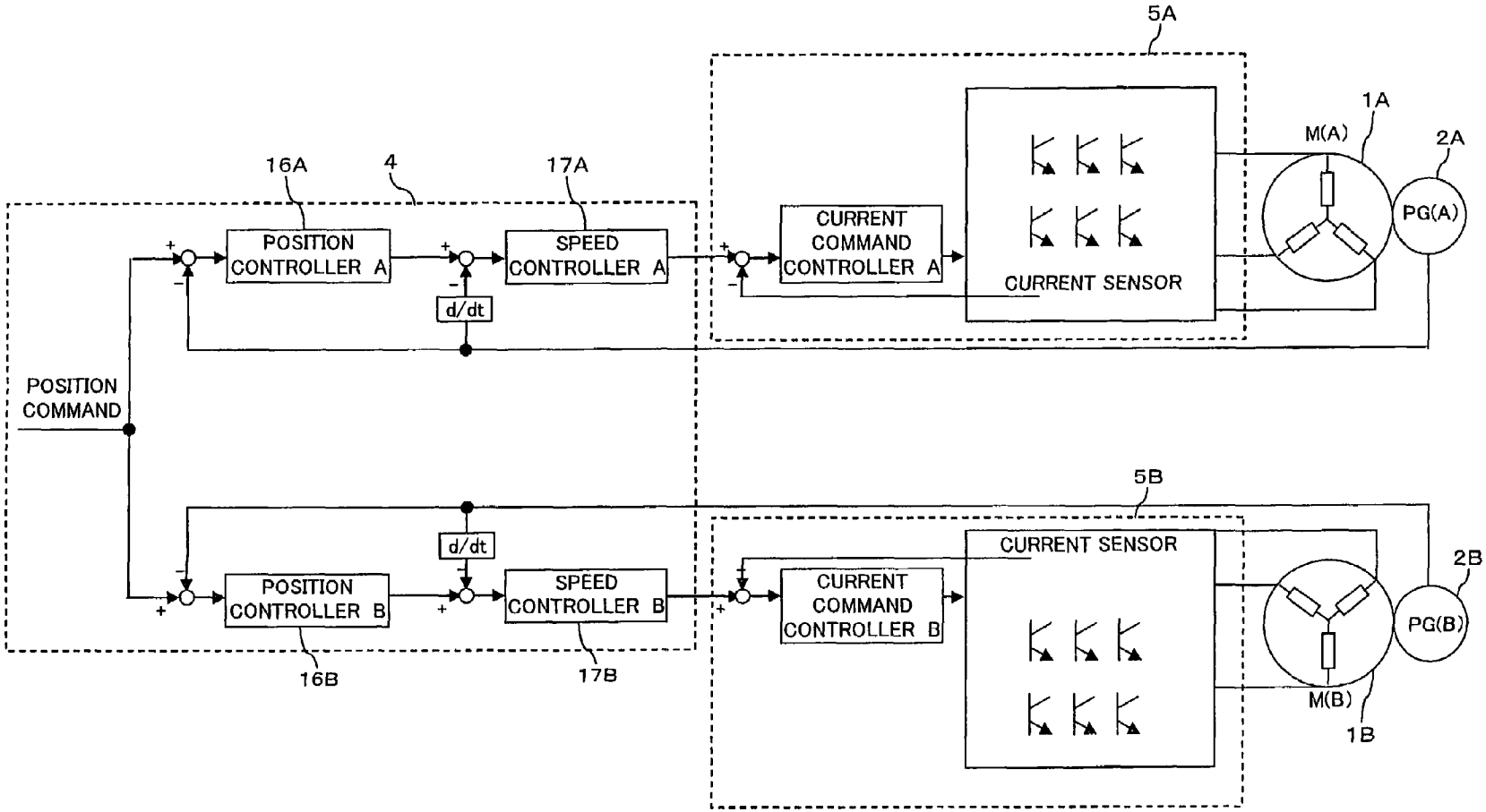
FIG. 3 is a block diagram generally showing the circuit configuration of an elevator control device according to a first embodiment of the invention.

FIG. 3 is a block diagram generally showing the circuit configuration of an elevator control device according to a first embodiment of the invention.

Referring to FIG. 1, the elevator control device includes position sensors 2A, 2B employing rotary encoders. These position sensors 2A, 2B detect car position based on angular positions of the rotors of the traction units 1A, 1B, respectively, and output position values corresponding to the detected angular positions of the rotors to a main control section 4.

In the main control section 4 shown in FIG. 3, a common position command is branched into two channels and entered into a pair of position controllers 16A, 16B. Position signals output from the position sensors 2A, 2B which are assembled in the traction units 1A, 1B are fed back into the position controllers 16A, 16B, respectively.

The position signals supplied from the position sensors 2A, 2B are differentiated to produce detected speed signals, which are fed back into speed controllers 17A, 17B, respectively.

The elevator control device further includes current controllers 5A, 5B incorporating current command controllers and pulsewidth-modulation (PWM) inverters. Current values detected by respective current sensors are fed back into the current command controllers. The PWM inverters of the current controllers 5A, 5B supply 3-phase alternating currents (AC) generated based on voltage command signals fed from the current command controllers to the synchronous motors of the traction units 1A, 1B.

Control operation performed by the elevator control device of the embodiment is now explained. The position controllers 16A, 16B generate speed commands to be supplied to the speed controllers 17A, 17B in such a manner that the current positions of the rotors of the traction units 1A, 1B detected by the position sensors 2A, 2B match the given position command. The speed controllers 17A, 17B generate current commands to be supplied to the current controllers 5A, 5B in such a manner that the detected speed signals obtained by differentiating the detected position signals match the speed commands generated by the position controllers 16A, 16B.

The traction units 1A, 1B are acted on by reaction forces exerted by the ropes 3A, 3B via the respective sheaves 8A, 8B, 9A, 9B (9). These reaction forces act as disturbance torques on control systems of the traction units 1A, 1B. Since the reaction forces are caused by driving (pulling) forces of the ropes 3A, 3B and friction forces between the ropes 3A, 3B and the sheaves 8A, 8B, 9A, 9B (9), the reaction force exerted on the traction unit 1A is not always equal to the reaction force exerted on the traction unit 1B under normal operating conditions. For this reason, the two traction units 1A, 1B could occasionally be situated at different angular positions. The position signals representing the angular positions of the rotors of the individual traction units 1A, 1B are fed back to decrease a position error caused by the difference between the positions of the two traction units 1A, 1B.

As is the case with the angular positions of the traction units 1A, 1B, there could occur a difference between rotating speeds of the two traction units 1A, 1B. This difference in the rotating speeds of the traction units 1A, 1B would cause vibration and sway of the car 6. The speed signals obtained by differentiating the detected position signals supplied from the position sensors 2A, 2B of the traction units 1A, 1B are fed back to suppress the occurrence of vibration and sway of the car 6.

The current controllers 5A, 5B act in such a way that the current values detected by the current sensors coincide with the current commands (corresponding to torque commands) generated by the speed controllers 17A, 17B. Should there exist a difference in electrical response properties between the two traction units 1A, 1B, the traction units 1A, 1B would not produce torques at the same timing. Such a disparity in the timing of torque generation by the two traction units 1A, 1B causes fluctuation in combined torque, resulting in vibration and sway of the car 6. Thus, signals on the current values detected by the current sensors are fed back to the respective current controllers 5A, 5B to equalize the response properties of the two traction units 1A, 1B so that the car 6 would not produce vibration or sway motion.

While the aforementioned control operation of the elevator control device is aimed at eventually controlling car position (vertical positions of the ropes 3A, 3B supporting the car 6), position control alone could not provide sufficient follow-up performance against various changes. Under this circumstance, the elevator control device of the present embodiment feeds back changes in speeds (i.e., differentials of the detected position values) and accelerations (which correspond to the torques and current commands) which can be detected earlier than the position changes, so that the embodiment makes it possible to achieve control performance which ensures precise synchronization of motions of the traction units 1A, 1B and the ropes 3A, 3B.

Depending on the control performance required for the elevator control device and conditions of elevator drive mechanisms including the traction units 1A, 1B, the circuit configuration of the embodiment (FIG. 3) may be modified in such a way that only the position signals representing the angular positions of the traction units 1A, 1B are fed back to the position controllers 16A, 16B, still ensuring trouble-free stable operation of the elevator system.

While various other embodiments of the invention intended to improve control characteristics of elevator control devices for driving multiple traction units will be described below, the following discussion will focus mainly on those parts of the elevator control devices which differ from the elevator control device of the first embodiment.

Second Embodiment

Figure 4:
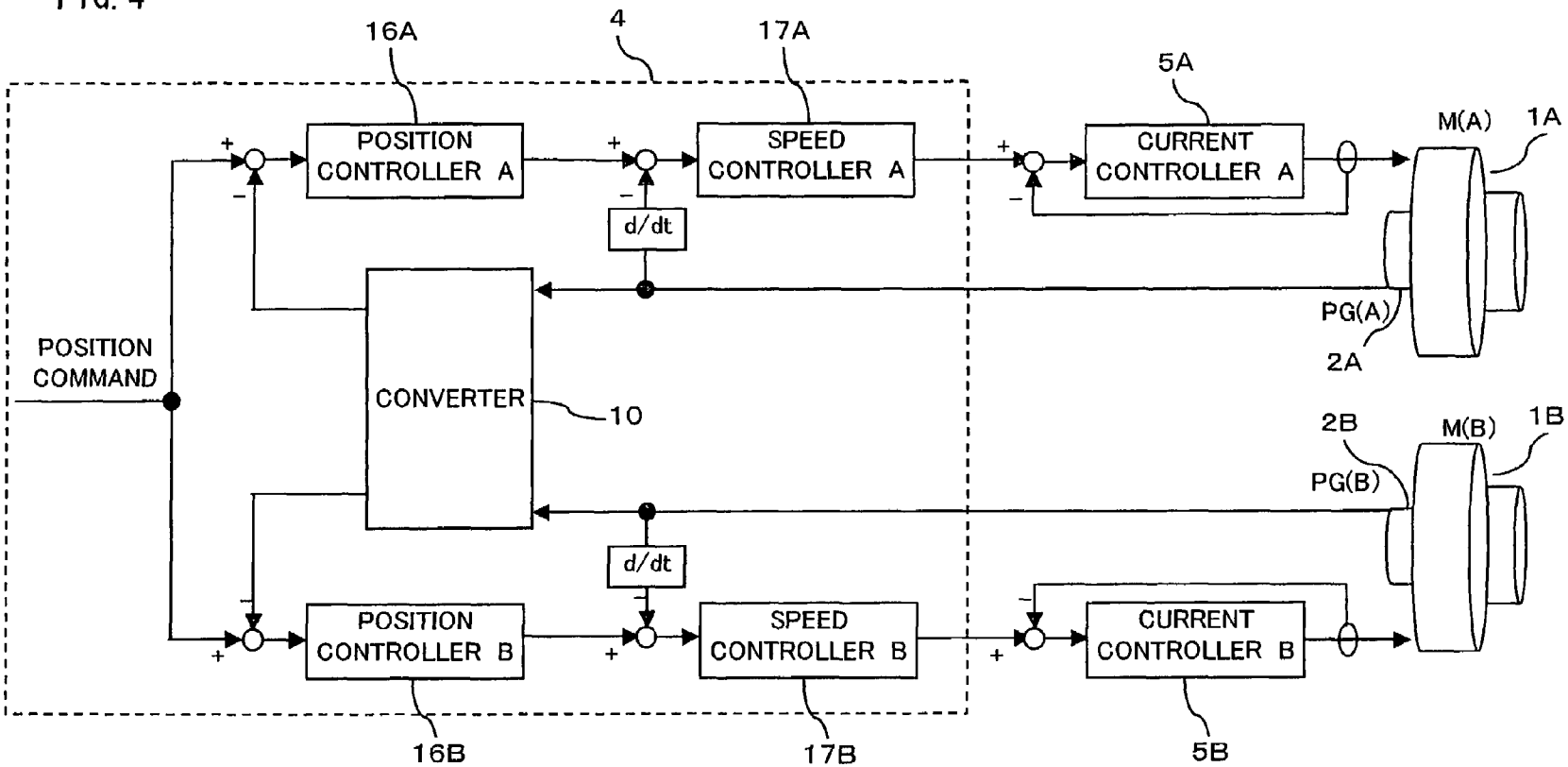
FIG. 4 is a block diagram generally showing the circuit configuration of an elevator control device according to a second embodiment of the invention.

FIG. 4 is a block diagram generally showing the circuit configuration of an elevator control device according to a second embodiment of the invention.

Figure 5:
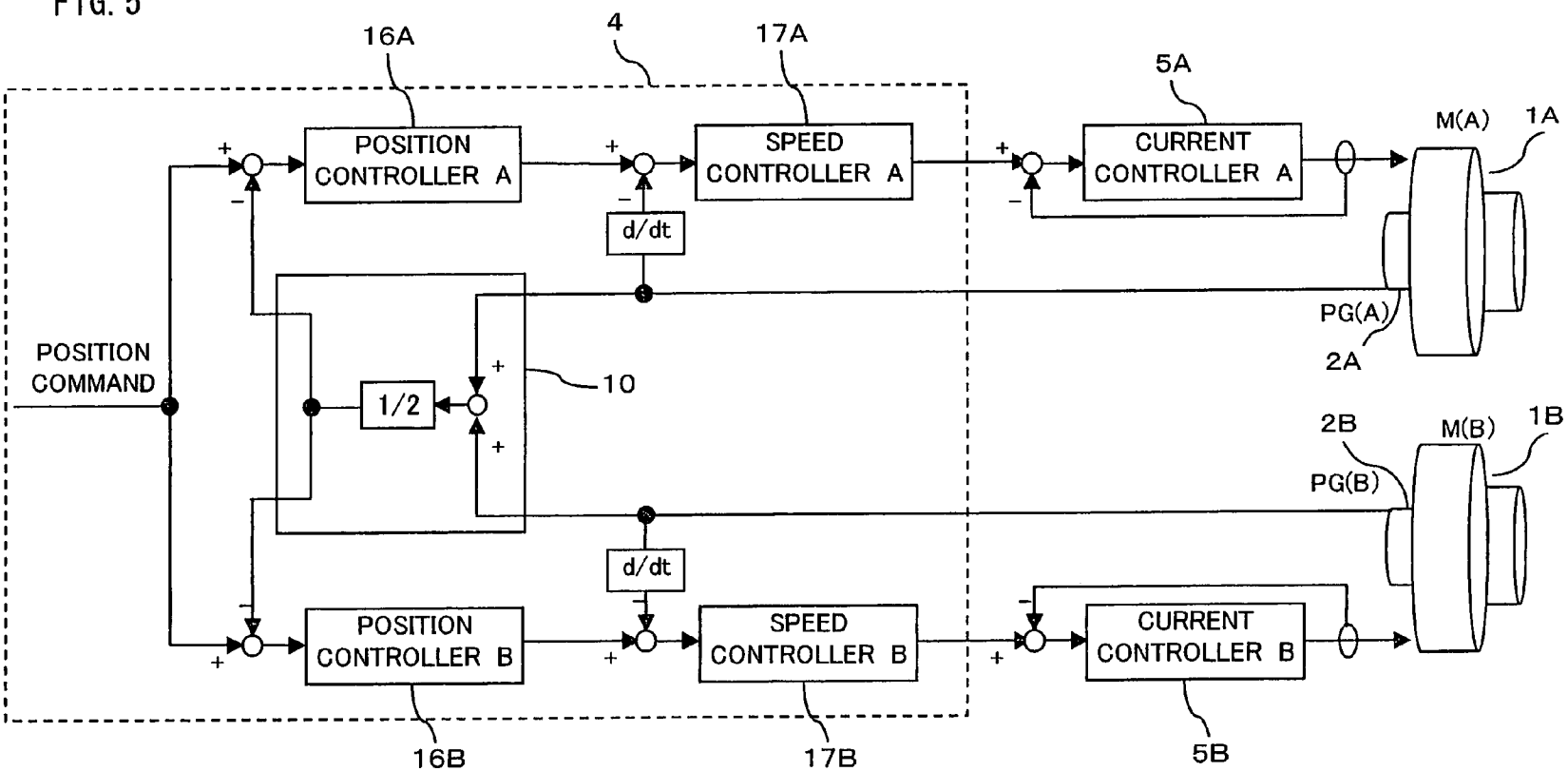
FIG. 5 is a block diagram more specifically showing the circuit configuration of the elevator control device of FIG. 4.

The elevator control device of this embodiment also includes position sensors 2A, 2B which are assembled in the traction units 1A, 1B, respectively. Position signals output from the position sensors 2A, 2B are entered into a position output converter 10. Output signals of the position output converter 10 are fed back into position controllers 16A, 16B. As shown in FIG. 5, the position output converter 10 calculates the arithmetic mean of the two position signals and feeds back the same to the individual position controllers 16A, 16B, for example.

When the difference between the positions of the two traction units 1A, 1B is extremely large, a large difference corresponding to the position difference occurs between the speed commands generated by the individual position controllers 16A, 16B in the first embodiment of FIG. 3. As a result, there arises an extremely large difference in torque applied to the individual ropes 3A, 3B, resulting in swaying of the car 6. By comparison, this kind of extraordinary phenomenon is alleviated and undesired swaying is suppressed in the second embodiment, because the arithmetic mean of the position signals output from the position sensors 2A, 2B is fed back to the position controllers 16A, 16B.

While the position output converter 10 depicted in FIG. 5 performs a process of averaging the two position signals (A, B) by simply taking their arithmetic mean ((A+B)/2), the invention is not limited to this mathematical operation. As an alternative, the averaging process performed by the position output converter 10 may take the square root of the sum of the two position signals ($\sqrt{A \times B}$)

Third Embodiment

Figure 6:
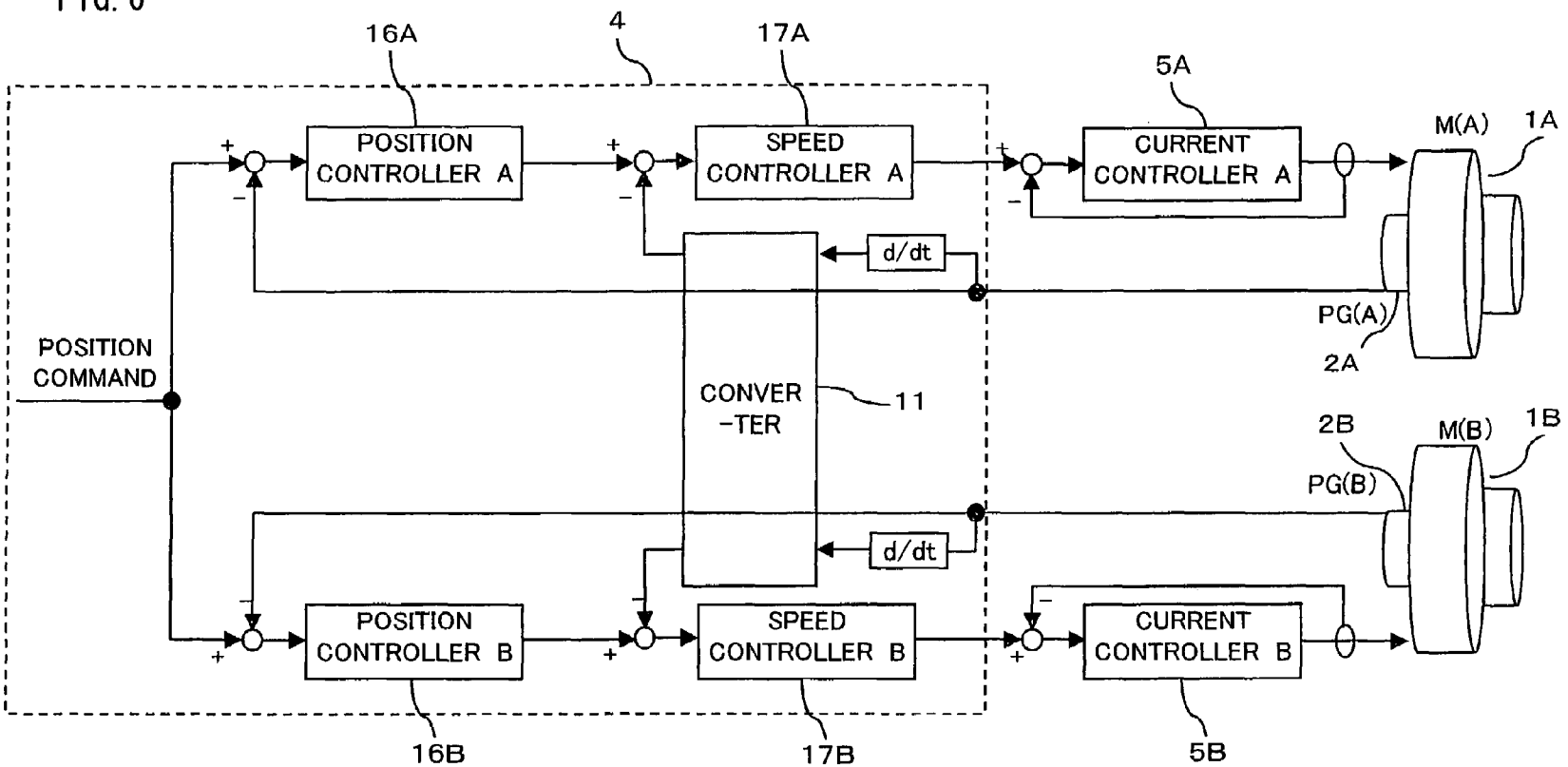
FIG. 6 is a block diagram generally showing the circuit configuration of an elevator control device according to a third embodiment of the invention.

FIG. 6 is a block diagram generally showing the circuit configuration of an elevator control device according to a third embodiment of the invention.

Figure 7:
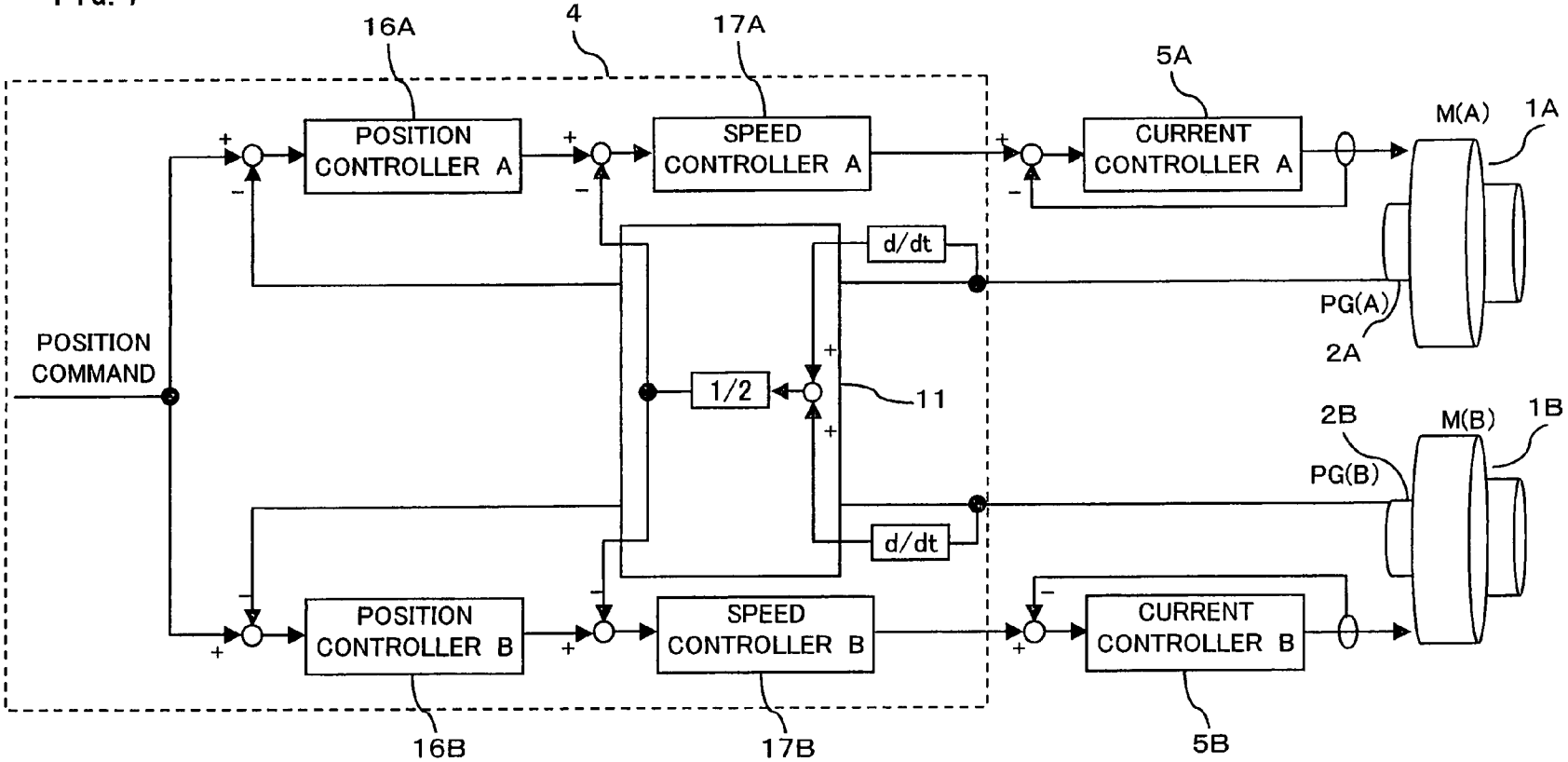
FIG. 7 is a block diagram more specifically showing the circuit configuration of the elevator control device of FIG. 6.

The elevator control device of this embodiment also includes position sensors 2A, 2B which are assembled in the traction units 1A, 1B, respectively. Signals obtained by differentiating position signals output from the position sensors 2A, 2B are entered into a position output differential converter 11. Output signals of the position output differential converter 11 are fed back into speed controllers 17A, 17B. As shown in FIG. 7, the position output differential converter 11 calculates the arithmetic mean of differentials of the two position signals, or averaged speed data, and feeds back the same to the individual speed controllers 17A, 17B, for example.

While this embodiment is effective in suppressing the occurrence of elevator car swaying too, the elevator control device of the embodiment differs from that of the second embodiment (FIGS. 4 and 5) in that the former offers a faster response to changes, since the elevator control device of the third embodiment employs a speed feedback loop in which the speed data are averaged whereas the elevator control device of the second embodiment employs a position feedback loop in which the position signals are averaged. For this reason, the elevator control device of the third embodiment can suppress vibration or sway motion more quickly.

While the position output differential converter 11 depicted in FIG. 7 performs a process of averaging the differentials of the two position signals (A', B') by simply taking their arithmetic mean ((A'+B')/2), the invention is not limited to this mathematical operation. As is the case with the second embodiment, the averaging process performed by the position output differential converter 11 may take the square root of the sum of the differentials of the two position signals ($\sqrt{A' \times B'}$).

Fourth Embodiment

Figure 8:
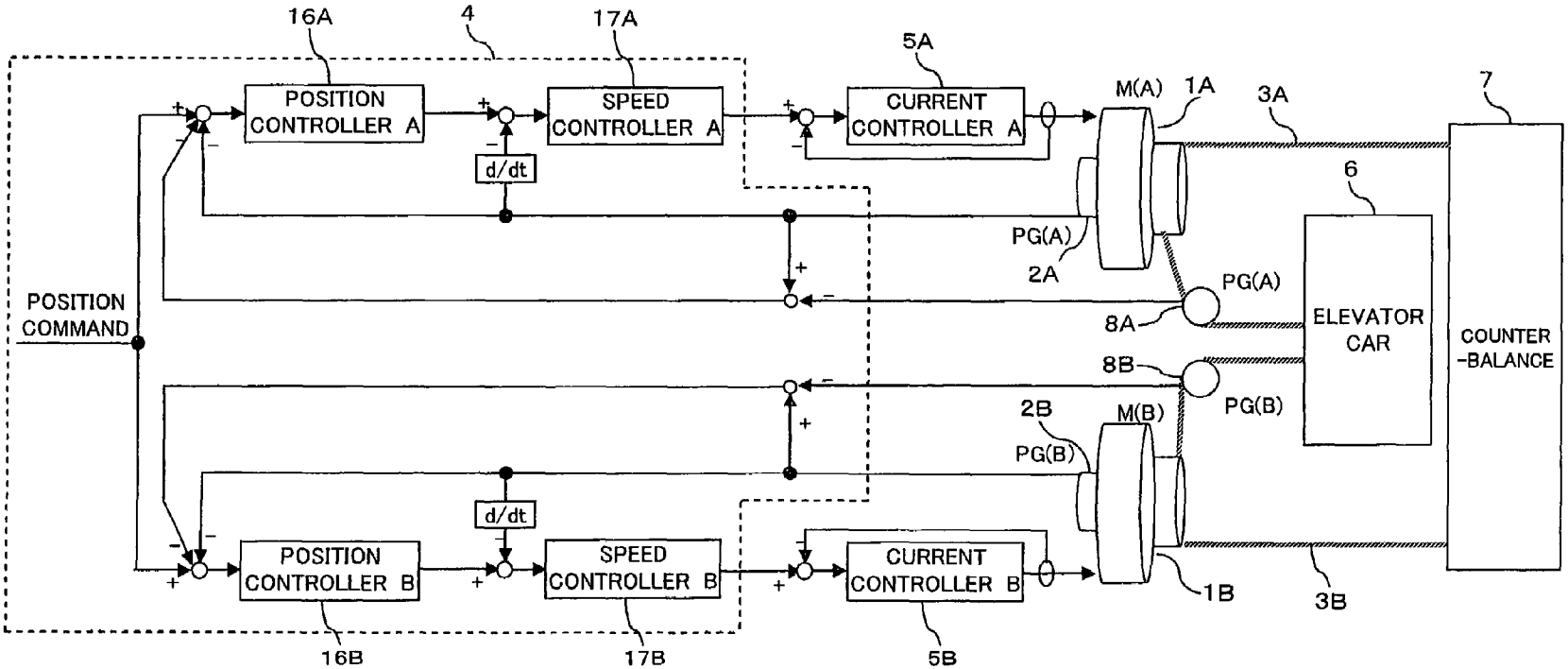
FIG. 8 is a block diagram generally showing the circuit configuration of an elevator control device according to a fourth embodiment of the invention.

FIG. 8 is a block diagram generally showing the circuit configuration of an elevator control device according to a fourth embodiment of the invention.

Referring to FIG. 8, the elevator control device of this embodiment includes second position sensors which are disposed at a pair of overhead sheaves 8A, 8B for detecting car position based on angular positions of the overhead sheaves 8A, 8B in addition to first position sensors 2A, 2B which are assembled in the traction units 1A, 1B for detecting the car position based on angular positions of the rotors of the motors of the traction units 1A, 1B. A main control section 4 of the elevator control device calculates differences between position signals output from the first position sensors 2A, 2B and position signals output from the second position sensors, and feeds back difference signals obtained to respective position controllers 16A, 16B, as can be seen from FIG. 8.

The position sensors 2A, 2B intended to detect the car position based on the angular positions of the rotors of the traction units 1A, 1B have high-speed response. Therefore, the angular position is an optimum feedback quantity in control operation. During acceleration and deceleration of the traction units 1A, 1B, particularly when the rate of speed change is large, however, the hoist ropes 3A, 3B may stretch or slip along the drive sheaves which are fixedly connected to the rotors of the traction units 1A, 1B. Consequently, the angular positions detected by the position sensors 2A, 2B may not correctly represent the position of the car 6.

By comparison, the second position sensors for detecting the car position based on the angular positions of the overhead sheaves 8A, 8B are not substantially affected by the acceleration and deceleration of the traction units 1A, 1B. This is because the overhead sheaves 8A, 8B are driven sheaves which rotate as the ropes 3A, 3B run.

The aforementioned difference signals are fed back to the position controllers 16A, 16B to make up for sensing errors of the position sensors 2A, 2B potentially arising due to acceleration or deceleration by the position signals output from the second position sensors representing the angular positions of the overhead sheaves 8A, 8B.

The elevator control device of the fourth embodiment thus constructed makes it possible to controllably operate the elevator system while compensating for position errors by individually driving the traction units 1A, 1B even when the two hoist ropes 3A, 3B stretch or slip along the drive sheaves by unequal amounts. Overall, the elevator control device of the embodiment serves to ensure stable running of the car 6 and keep it from swaying or listing.

While the second position sensors are disposed at the overhead sheaves 8A, 8B, the invention is not limited to this construction. For example, the second position sensors may be disposed at a pair of deflector sheaves 9A, 9B which are also driven to rotate like the overhead sheaves 8A, 8B as the ropes 3A, 3B run.

Fifth Embodiment

Figure 10:
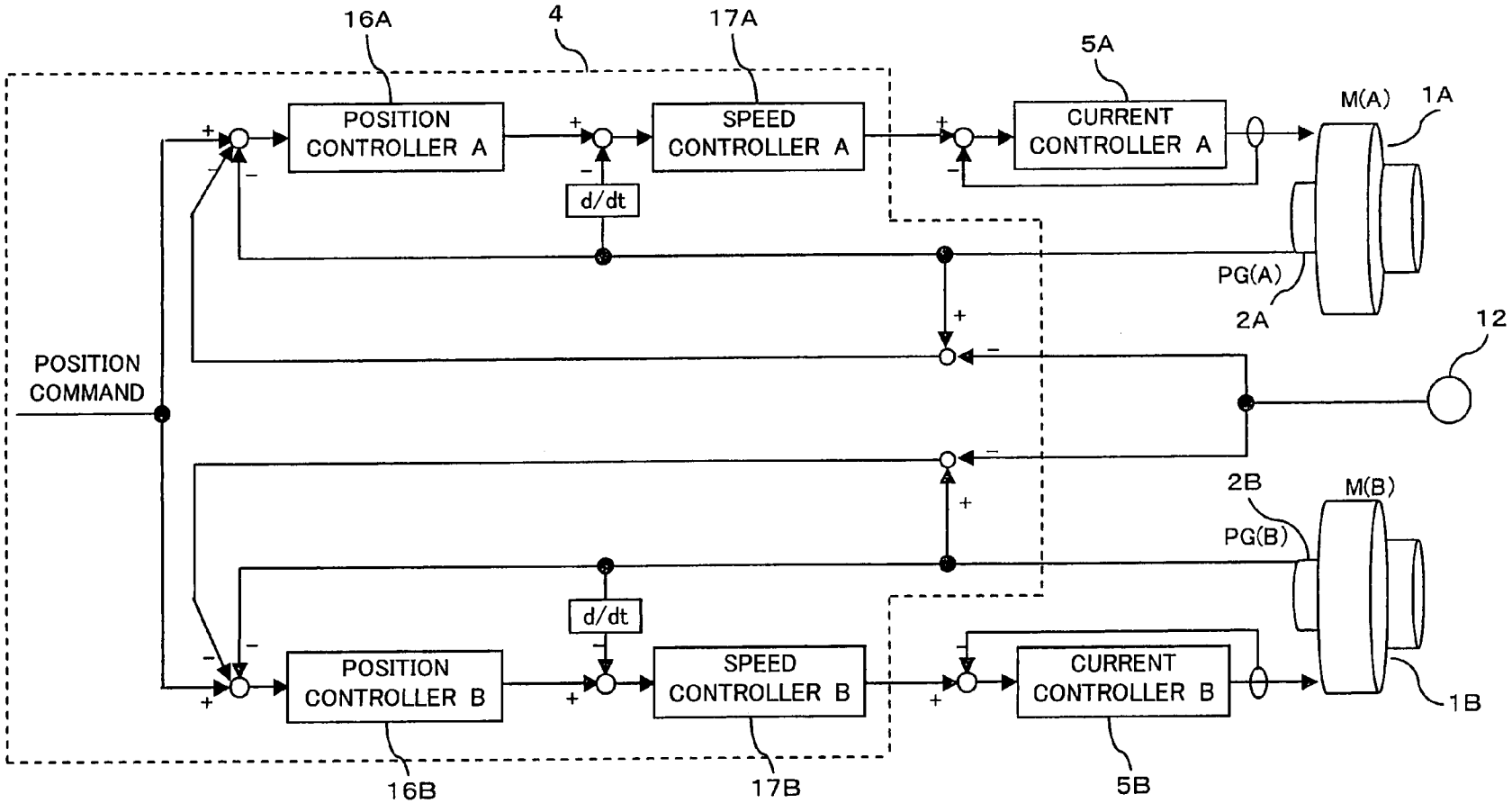
FIG. 10 is a block diagram generally showing the circuit configuration of the elevator control device according to the fifth embodiment of the invention.

FIG. 10 is a block diagram generally showing the circuit configuration of an elevator control device according to a fifth embodiment of the invention.

Like the fourth embodiment, the fifth embodiment is intended to prevent degradation of position detecting accuracy caused by acceleration or deceleration of the traction units 1A, 1B. Specifically, the elevator control device of this embodiment employs a third position sensor for detecting car position based on an angular position of a governor 12 shown in FIG. 9. A main control section 4 of the elevator control device calculates differences between position signals output from first position sensors 2A, 2B and a position signal output from the third position sensor disposed at the governor 12, and feeds back difference signals obtained to respective position controllers 16A, 16B, as can be seen from FIG. 10.

Figure 9:
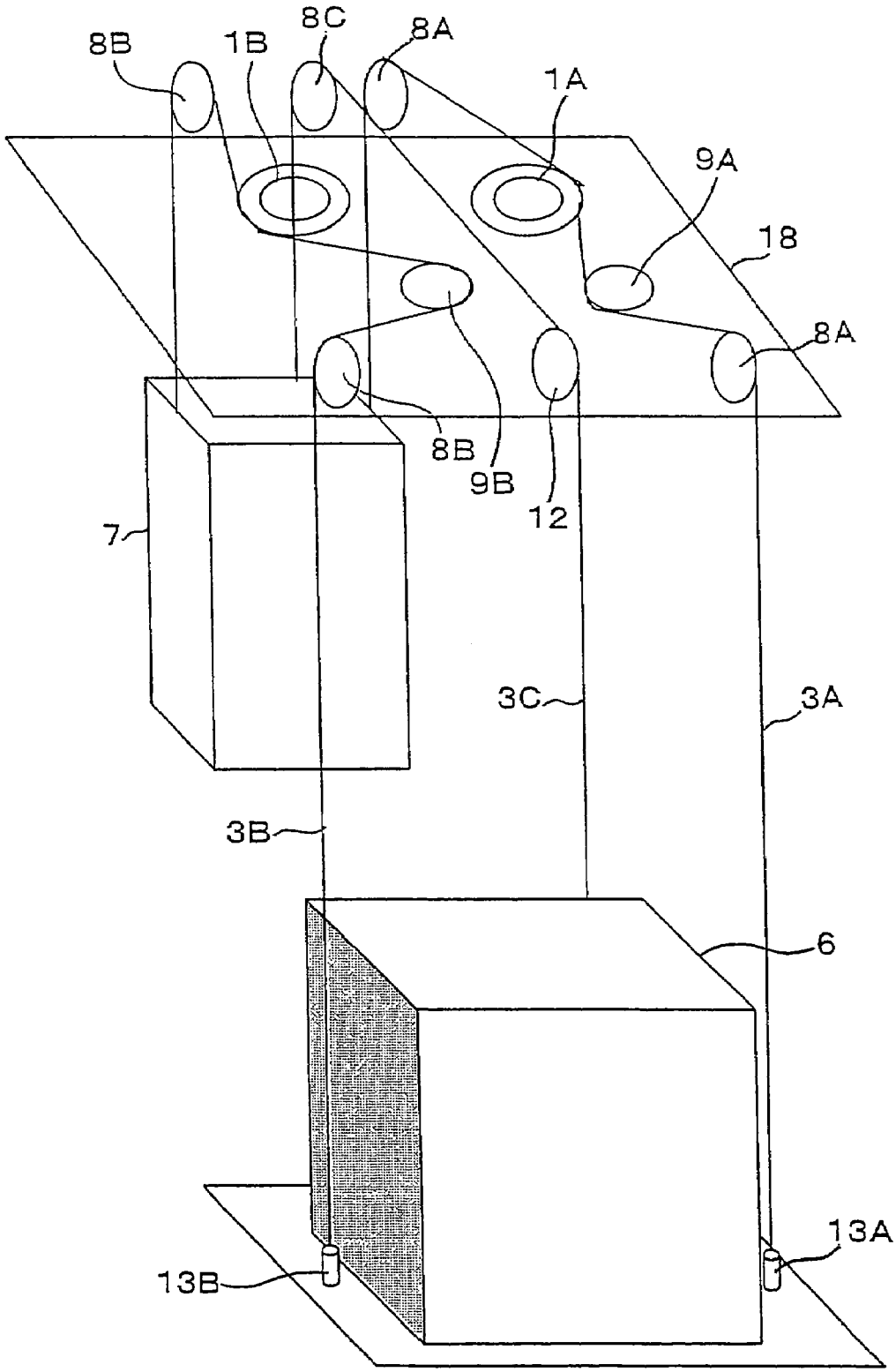
FIG. 9 is a schematic diagram showing the construction of an elevator system to which an elevator control device according to a fifth embodiment of the invention is applied.

As shown in FIG. 9, the governor 12 is essentially a driven wheel which rotates as a rope 3C runs, the rope 3C being connected between the car 6 and the counterbalance 7 separately from the hoist ropes (driving ropes) 3A, 3B. A position sensing signal output by the governor 12 is normally used for detecting the up-down position of the car 6. Since tensile forces caused by the driving (pulling) forces of the traction units 1A, 1B are not acted on the rope 3C, the output signal of the third position sensor is almost unaffected by acceleration or deceleration of the traction units 1A, 1B compared to output signals of other types of position sensors which detect the car position based on angular positions of such elements as the overhead sheaves 8A, 8B or the deflector sheaves 9A, 9B. Thus, the third position sensor serves to offer an improved ability to make up for sensing errors of the position sensors 2A, 2B potentially arising due to acceleration or deceleration.

Sixth Embodiment

Figure 11:
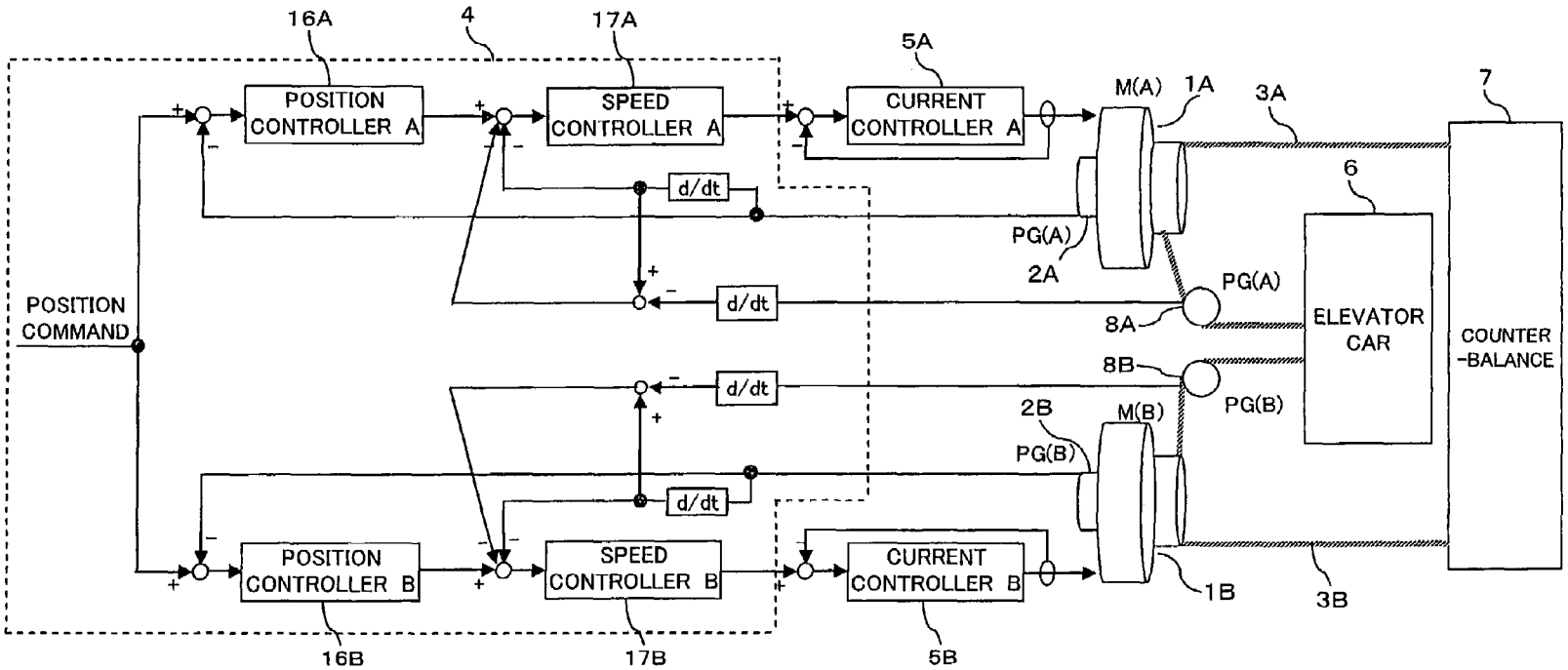
FIG. 11 is a block diagram generally showing the circuit configuration of an elevator control device according to a sixth embodiment of the invention.

FIG. 11 is a block diagram generally showing the circuit configuration of an elevator control device according to a sixth embodiment of the invention.

Referring to FIG. 11, the elevator control device of this embodiment includes second position sensors which are disposed at a pair of overhead sheaves 8A, 8B. Position signals output from the second position sensors are differentiated to produce detected speed signals. Also, position signals output from first position sensors 2A, 2B which are assembled in the traction units 1A, 1B are differentiated to produce detected speed signals. A main control section 4 of the elevator control device calculates differences between the speed signals derived from the output position signals of the second position sensors and the speed signals derived from the output position signals of the first position sensors 2A, 2B, and feeds back difference signals obtained to respective speed controllers 17A, 17B, as can be seen from FIG. 11.

The elevator control device of the sixth embodiment thus constructed makes it possible to feed back the correct speed of the car 6 using the detected speed signals obtained by differentiating the output position signals of the second position sensors disposed at the individual overhead sheaves 8A, 8B even when the two hoist ropes 3A, 3B slip along the drive sheaves of the traction units 1A, 1B due to acceleration or deceleration thereof and vibration occurs due to a difference in the amounts of slippage. Overall, the elevator control device of the embodiment serves to ensure stable running of the car 6.

While the second position sensors are disposed at the overhead sheaves 8A, 8B, the invention is not limited to this construction. For example, the second position sensors may be disposed at a pair of deflector sheaves 9A, 9B which are also driven to rotate like the overhead sheaves 8A, 8B as the ropes 3A, 3B run.

Figure 12:
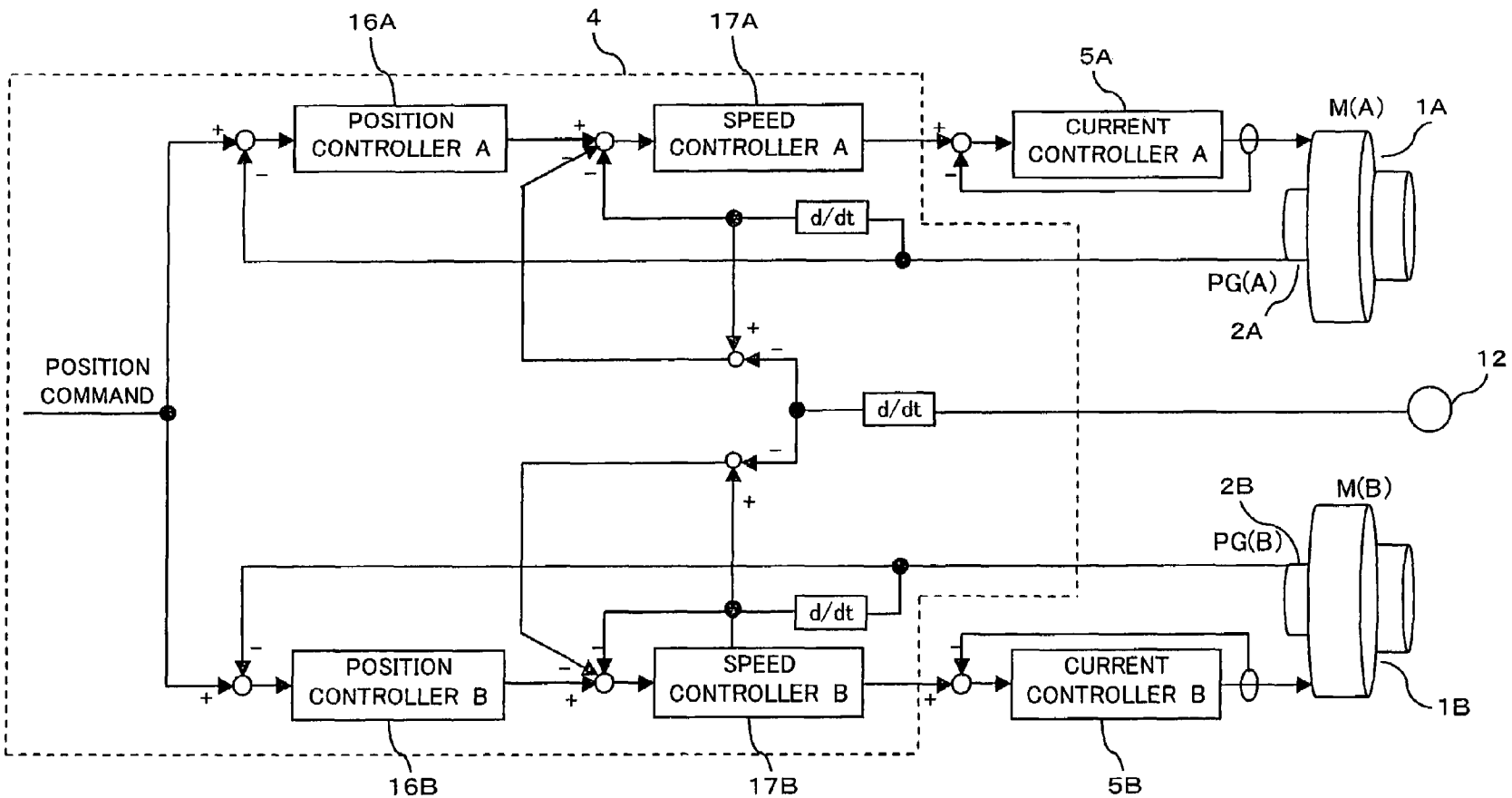
FIG. 12 is a block diagram generally showing the circuit configuration of an elevator control device in one varied form of the sixth embodiment of the invention.

The elevator control device of the aforementioned sixth embodiment may be modified to employ a third position sensor for detecting car position based on an angular position of a governor 12 instead of the second position sensors disposed at the overhead sheaves 8A, 8B as shown in FIG. 12. In the elevator control device of this variation of the sixth embodiment, a main control section 4 calculates differences between detected speed signals obtained by differentiating position signals output from first position sensors 2A, 2B and a detected speed signal obtained by differentiating a position signal output from the third position sensor disposed at the governor 12, and feeds back difference signals obtained to the respective speed controllers 17A, 17B, as can be seen from FIG. 12.

The elevator control device of this variation offers a further improved ability to make up for sensing errors of the position sensors 2A, 2B potentially arising due to acceleration or deceleration for the same reasons as already mentioned with reference to the fifth embodiment. Therefore, the elevator control device makes it possible to feed back the correct speed of the car 6 using the detected speed signals obtained by differentiating the output position signal of the third position sensor disposed at the governor 12 even when the two hoist ropes 3A, 3B slip along the drive sheaves of the traction units 1A, 1B due to acceleration or deceleration thereof and vibration occurs due to a difference in the amounts of slippage. Overall, the elevator control device of the variation of the sixth embodiment serves to ensure much stabler running of the car 6.

Seventh Embodiment

The aforementioned first to sixth embodiments are intended to provide elevator control devices which can ensure stable running of an elevator by precisely synchronizing the working of multiple traction units. These embodiments are applicable to the elevator systems employing either of the earlier-described driving systems shown in FIGS. 1 and 2.

Seventh to tenth embodiments of the invention described hereunder are intended to provide elevator control devices applicable to the elevator system of FIG. 1 which can more positively hold the elevator car 6 in a fixed position while the elevator car 6 is lifted up and down.

Figure 13:
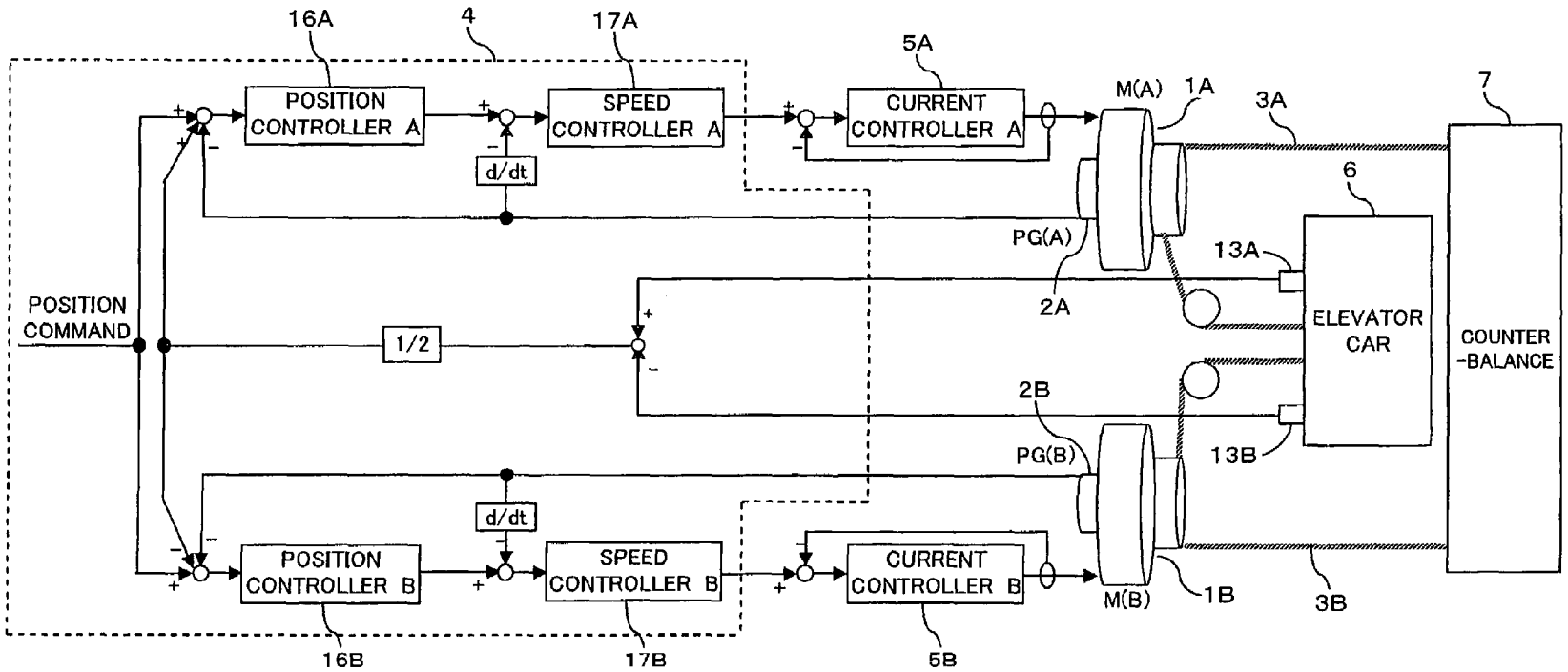
FIG. 13 is a block diagram generally showing the circuit configuration of an elevator control device according to a seventh embodiment of the invention.

FIG. 13 is a block diagram generally showing the circuit configuration of the elevator control device according to the seventh embodiment of the invention.

Referring to FIG. 13, the elevator control device of this embodiment includes a pair of weighing units 13A, 13B attached to the car 6. A position command correction signal corresponding to a value equal to one-half of the difference between output signals of the weighing units 13A, 13B is added to and subtracted from a position command entered into position controllers 16A, 16B, respectively.

The weighing units 13A, 13B detect the amounts of loads, or weights, carried by the ropes 3A, 3B by measuring tensile forces acting on the respective ropes 3A, 3B. When elevator passengers are uniformly distributed in the car 6, the output signals of the two weighing units 13A, 13B are equal to each other, so that the value fed back to the position controllers 16A, 16B is zero. In this case, the elevator control device of the embodiment works in exactly the same way as the elevator control device of the first embodiment. If the elevator passengers are unevenly situated in the car 6, the output signals of the two weighing units 13A, 13B become unequal. If the output signal of the weighing unit 13A has a larger value than that of the weighing unit 13B, for example, the rope 3A carries a weight greater than one-half of the total weight of the car 6 including the passengers while the rope 3B carries a weight smaller than one-half of the total weight.

Since driving forces produced by the two traction units 1A, 1B are equal to each other, acceleration of the rope 3A produced by the traction unit 1A becomes smaller than acceleration of the rope 3B produced by the traction unit 1B by an amount corresponding to the difference between the weights carried by the rope 3A and 3B. In this situation, the two ropes 3A, 3B would haul the car 6 at different speeds, causing vibration of the car 6, unless an appropriate correction is made to control systems of the traction units 1A, 1B to compensate for the difference in hauling speed. In addition, the car 6 will be left inclined in one direction without such corrective action.

Under these circumstances, the elevator control device of this embodiment employs the circuit configuration shown in FIG. 13. In the aforementioned example in which the rope 3A carries a greater weight than the rope 3B, the difference between the values of the output signals of the two weighing units 13A, 13B is regarded as positive, and the position command correction signal corresponding to the value equal to one-half of the difference between output signals of the weighing units 13A, 13B added to the position command input into the position controller 16A and subtracted from the position command input into the position controller 16B.

Therefore, the position command entered into the position controller 16A is advanced by a specified amount of correction whereas the position command entered into the position controller 16B is delayed by the same amount of correction. Consequently, the control system of the traction unit 1A increases its input current, and thus a torque produced, so that the hauling speed of the traction unit 1A increases. On the other hand, the control system of the traction unit 1B decreases its input current, and thus a torque produced, so that the hauling speed of the traction unit 1B decreases. As a result, accelerations produced by the traction units 1A and 1B become balanced and vibration of the car 6 is suppressed. Since the traction units 1A, 1B are driven in a controlled fashion to reduce inclination of the car 6 caused by unbalanced location of the passengers as mentioned above, the elevator control devices of this embodiment makes it possible to hold the car 6 in a horizontal position.

Eighth Embodiment

Figure 14:
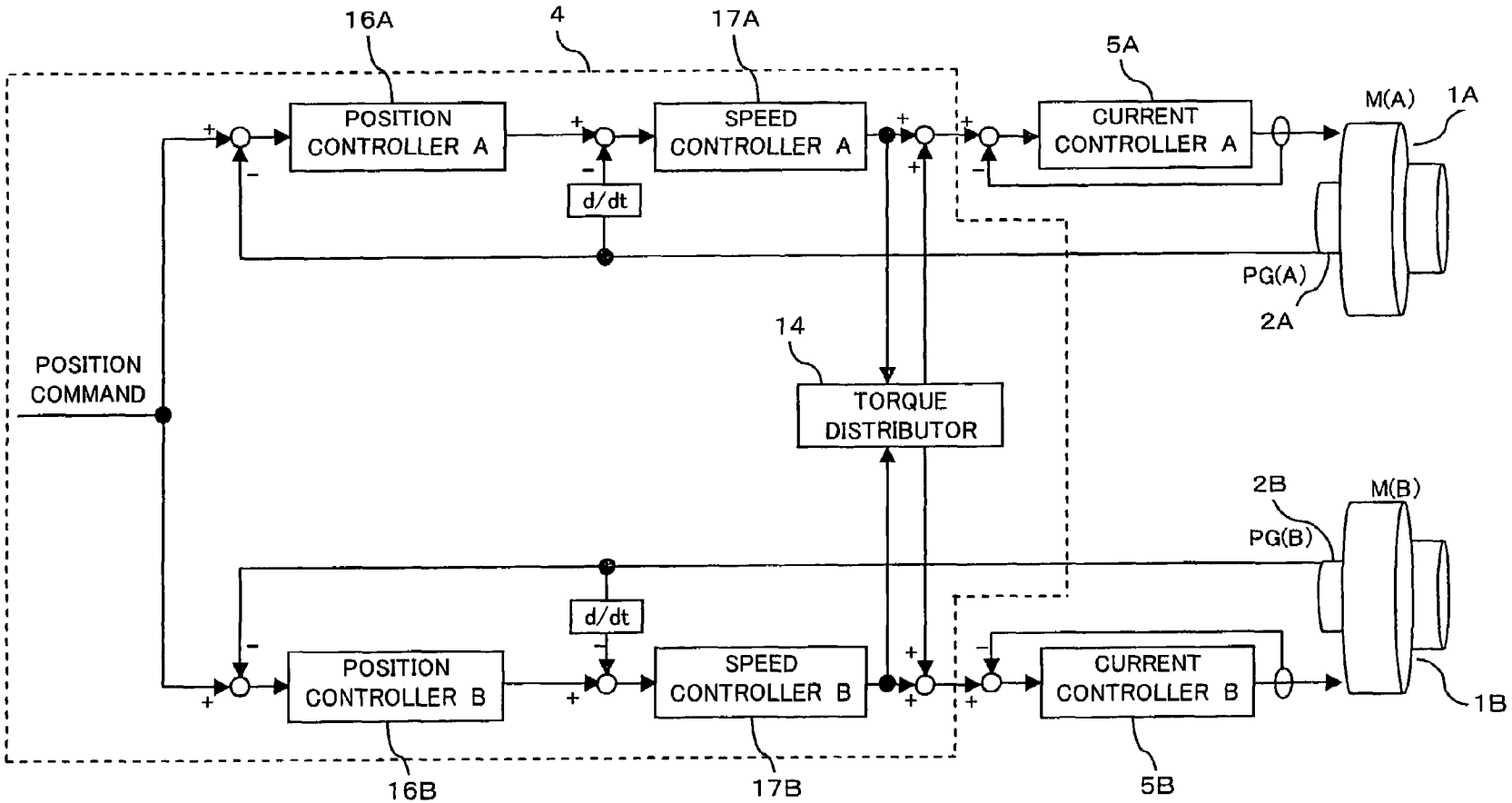
FIG. 14 is a block diagram generally showing the circuit configuration of an elevator control device according to an eighth embodiment of the invention.

FIG. 14 is a block diagram generally showing the circuit configuration of the elevator control device according to the eighth embodiment of the invention.

Referring to FIG. 14, the elevator control device of this embodiment includes a torque distributor 14 for distributing torque commands (current commands) output from speed controllers 17A, 17B at an appropriate redistribution ratio, the torque distributor 14 including a low-pass filter having desirable time constant characteristics. The current command output from the speed controller 17A and the current command output from the speed controller 17B are input into the torque distributor 14. The torque distributor 14 outputs current command correction signals obtained by entering the difference between the two current commands into the low-pass filter. These outputs (current command correction signals) of the torque distributor 14 are added to inputs of current controllers 5A, 5B.

In a case where one of the two hoist ropes 3A, 3B would not move smoothly at the beginning of rotation of the drive sheaves of the traction units 1A, 1B, for instance, there would occur a difference between the torque commands (current commands) sent to the current controllers 5A, 5B. If one of the ropes 3A, 3B which has hardly moved begins to move or slip abruptly, there can arise a situation in which a larger torque is applied to one of the ropes 3A, 3B for an extended period of time, causing vibration of the car 6. This is because the difference between the two current commands does not diminish instantly. The elevator control device of this embodiment smoothens the varying torque commands by means of the low-pass filter incorporated in the torque distributor 14 to prevent such abrupt changes in the torque commands and thereby suppress the occurrence of vibration of the car 6.

Ninth Embodiment

Figure 15:
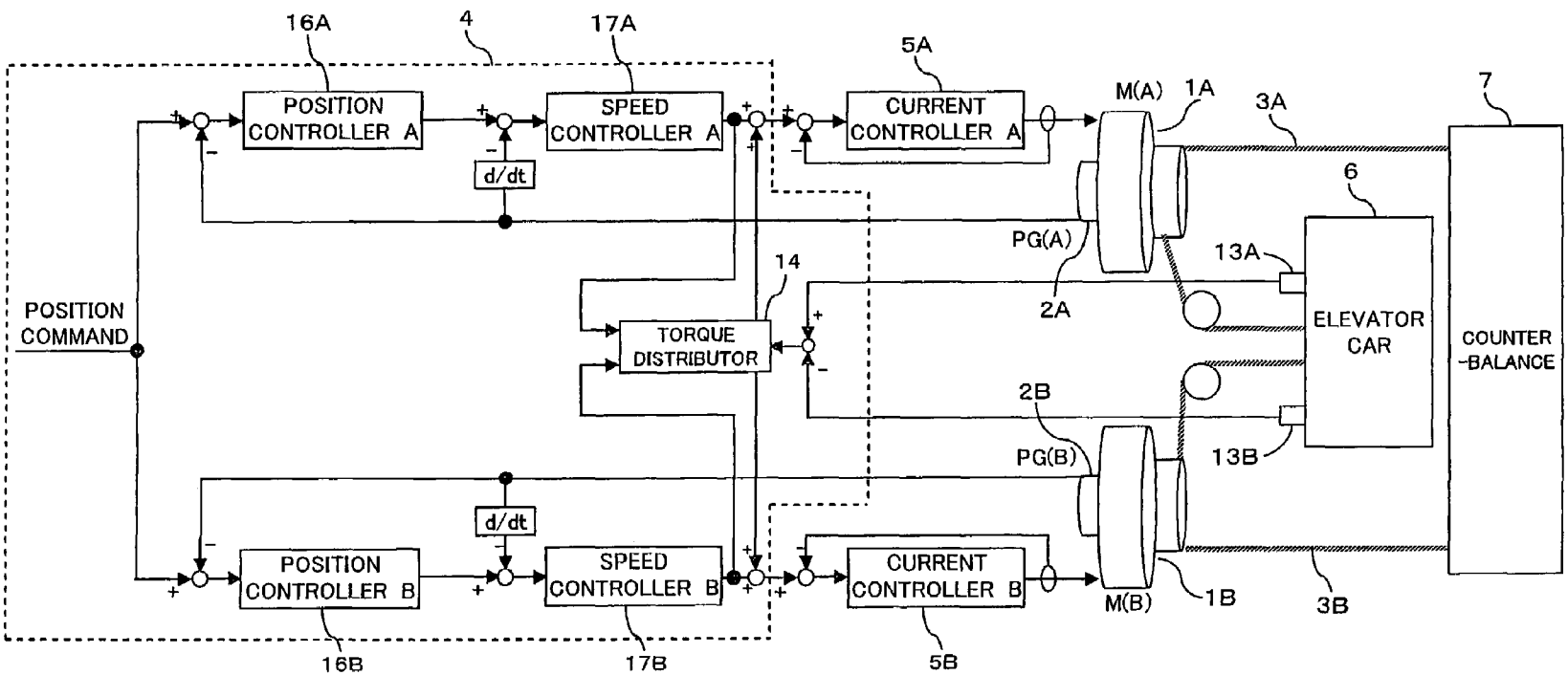
FIG. 15 is a block diagram generally showing the circuit configuration of an elevator control device according to a ninth embodiment of the invention.

FIG. 15 is a block diagram generally showing the circuit configuration of the elevator control device according to the ninth embodiment of the invention.

In the seventh embodiment shown in FIG. 13, the position command correction signal obtained from the difference between the outputs of the weighing units 13A, 13B is added to and subtracted from the position command entered into the position controllers 16A, 16B, respectively, to hold the car 6 in a horizontal position.

In the ninth embodiment, the difference between the outputs of the two weighing units 13A, 13B is used as a current command correction signal. This current command correction signal is added to inputs of current controllers 5A, 5B together with current command correction signals output from a torque distributor 14 which has already been discussed with reference to the eighth embodiment shown in FIG. 14.

Accordingly, the elevator control device of the ninth embodiment exhibits advantageous features of both the seventh and eighth embodiments, making it possible to suppress undesirable vibration of the car 6 and hold the car 6 in a horizontal position.

Tenth Embodiment

Figure 16:
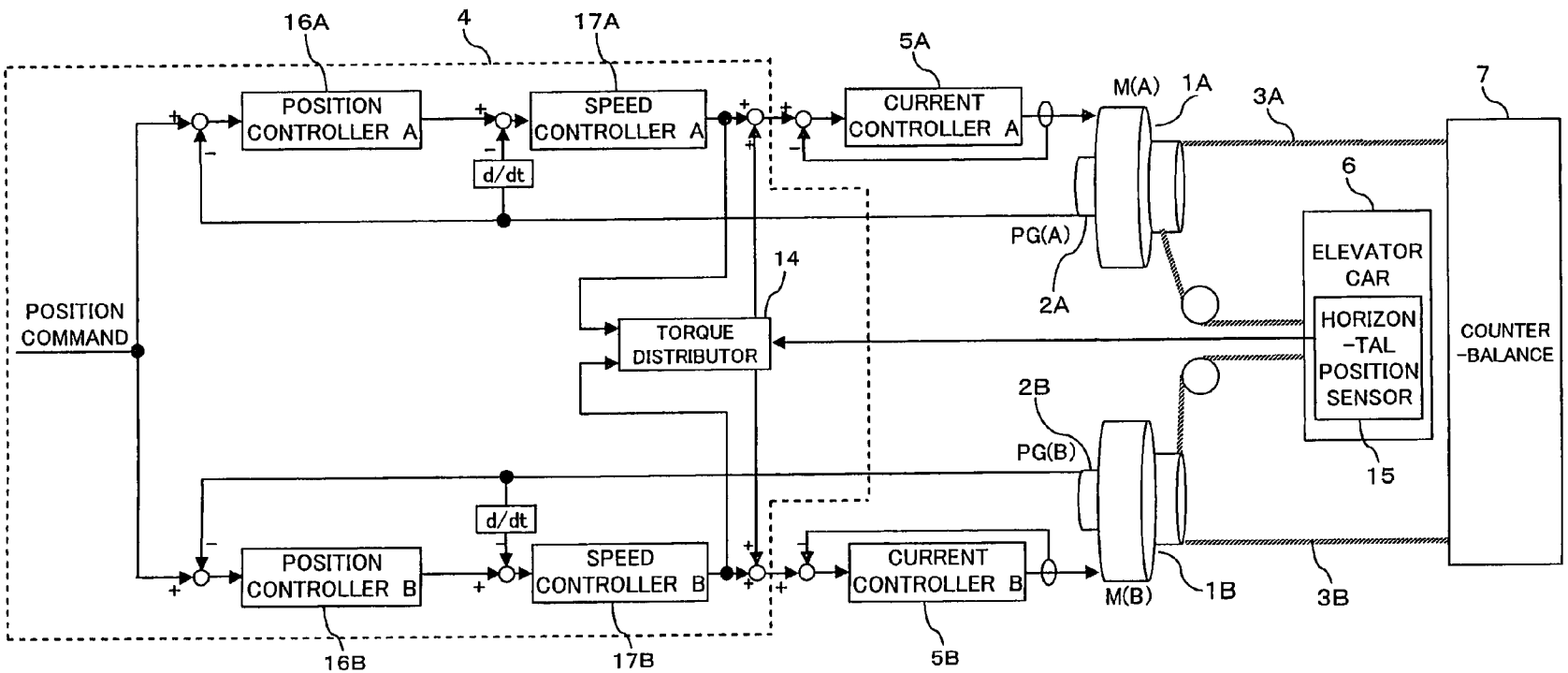
FIG. 16 is a block diagram generally showing the circuit configuration of an elevator control device according to a tenth embodiment of the invention.

FIG. 16 is a block diagram generally showing the circuit configuration of the elevator control device according to the tenth embodiment of the invention.

The elevator control device of the tenth embodiment includes a horizontal position sensor 15 attached to the car 6 for detecting the horizontality of the car 6 instead of the weighing units 13A, 13B explained with reference to the ninth embodiment shown in FIG. 15. The elevator control device of this embodiment generates a current command correction signal from a sensing signal output from horizontal position sensor 15. Like the elevator control device of the ninth embodiment, the elevator control device of this embodiment serves to suppress undesirable vibration of the car 6 and hold the car 6 in a horizontal position.

In summary, an elevator control device of the invention for controlling up-down movements of a load-carrying car by driving a plurality of traction units which haul a hoist rope interconnecting the car and a counterbalance includes position sensors disposed at the traction units for detecting car position by sensing positions of the individual traction units, and current supplies for supplying electric currents to the individual traction units in which each of the current supplies generates the electric current based on an input difference between a common position command for the traction units and a feedback signal derived from an output of the position sensor disposed at the corresponding traction unit.

According to one feature of the invention, each of the current supplies includes a position controller for generating a speed command for the corresponding traction unit based on the input difference between the common position command and the feedback signal derived from the output of the pertinent position sensor, a speed controller for generating a current command for the corresponding traction unit based on an input difference between the speed command generated by the position controller and a feedback signal obtained by differentiating the output of the pertinent position sensor, and a current controller for supplying the electric current to the corresponding traction unit based on the current command generated by the speed controller.

The elevator control device thus constructed ensures stable running of an elevator by precisely synchronizing the working of multiple traction units.

According to another feature of the invention, the elevator control device further includes a position output converter for averaging the outputs of the position sensors. In this elevator control device, those feedback signals derived from the outputs of the position sensors which are supplied to the position controllers for the individual traction units are position signals obtained by averaging the outputs of the position sensors by the position output converter.

This construction serves to suppress unwanted vibration even when a large difference occurs between the positions of the individual traction units output from the position sensors.

According to another feature of the invention, the elevator control device further includes a position output differential converter for averaging differentials of the outputs of the position sensors. In this elevator control device, those feedback signals obtained by differentiating the outputs of the position sensors which are supplied to the speed controllers for the individual traction units are position differential signals obtained by averaging the differentials of the outputs of the position sensors by the position output differential converter.

This construction also serves to suppress unwanted vibration even when a large difference occurs between the positions of the individual traction units output from the position sensors.

According to another feature of the invention, the aforementioned position sensors detect the positions of the individual traction units by sensing angular positions of rotors of the traction units.

This enables the position sensors to output the positions of the traction units with high-speed response.

According to another feature of the invention, the aforementioned position sensors are first position sensors which detect the car position by sensing angular positions of rotors of the traction units, and the elevator control device further includes second position sensors for detecting the car position based on angular positions of sheaves which are driven to rotate as the hoist rope runs. In this elevator control device, sensing errors of the first position sensors potentially caused by acceleration or deceleration by the traction units are compensated for by adding differences between the outputs of the first position sensors and outputs of the second position sensors to the input differences supplied to the position controllers for the individual traction units.

The elevator control device thus constructed ensures stable running of the car and keeps it from listing even when individual hoist ropes stretch or slip along the sheaves by unequal amounts.

According to another feature of the invention, the aforementioned position sensors are first position sensors which detect the car position by sensing angular positions of rotors of the traction units, and the elevator control device further includes a third position sensor for detecting the car position based on an angular position of a governor which are driven to rotate as a rope runs, the rope being connected between the car and the counterbalance without being acted upon by tensile forces produced by the traction units. In this elevator control device, sensing errors of the first position sensors potentially caused by acceleration or deceleration by the traction units are compensated for by adding differences between the outputs of the first position sensors and outputs of the third position sensors to the input differences supplied to the position controllers for the individual traction units.

The elevator control device thus constructed also ensures stable running of the car and keeps it from listing even when individual hoist ropes stretch or slip along the sheaves by unequal amounts.

According to another feature of the invention, the aforementioned position sensors are first position sensors which detect the car position by sensing angular positions of rotors of the traction units, and the elevator control device further includes second position sensors for detecting the car position based on angular positions of sheaves which are driven to rotate as the hoist rope runs. In this elevator control device, sensing errors of the first position sensors potentially caused by acceleration or deceleration by the traction units are compensated for by adding differences between differentials of the outputs of the first position sensors and differentials of outputs of the second position sensors to the input differences supplied to the speed controllers for the individual traction units.

The elevator control device thus constructed also ensures stable running of the car and keeps it from listing even when individual hoist ropes stretch or slip along the sheaves by unequal amounts.

According to another feature of the invention, the aforementioned position sensors are first position sensors which detect the car position by sensing angular positions of rotors of the traction units, and the elevator control device further includes a third position sensor for detecting the car position based on an angular position of a governor which are driven to rotate as a rope runs, the rope being connected between the car and the counterbalance without being acted upon by tensile forces produced by the traction units. In this elevator control device, sensing errors of the first position sensors potentially caused by acceleration or deceleration by the traction units are compensated for by adding differences between differentials of the outputs of the first position sensors and differentials of outputs of the third position sensors to the input differences supplied to the speed controllers for the individual traction units.

The elevator control device thus constructed also ensures stable running of the car and keeps it from listing even when individual hoist ropes stretch or slip along the sheaves by unequal amounts.

According to another feature of the invention, the car is supported by the same number of hoist ropes as the number of the traction units, and the traction units haul the individual hoist ropes.

The elevator control device of the invention enables the multiple traction units to haul the individual hoist ropes in a well-balanced fashion.

According to another feature of the invention, the car is supported by a plurality of hoist ropes, and at least two of the hoist ropes are run side by side at least in part and the traction units drive the car by hauling parallel-running portions of the hoist ropes.

The elevator control device of the invention can properly regulate driving forces produced by the individual traction units.

According to another feature of the invention, the elevator control device further includes weighing units attached to ends of the multiple hoist ropes on sides of the car for detecting weights carried by the hoist ropes. In this elevator control device, a position command correction signal produced based on the detected weights output from the weighing units is added to the input differences supplied to the position controllers for the individual traction units so that the detected positions of the individual traction units coincide with each other regardless of a difference between the detected weights output from the weighing units.

In this construction, accelerations produced by the individual traction units become balanced and vibration of the car is suppressed. Since the traction units are driven in a controlled fashion to reduce inclination of the car caused by unbalanced location of passengers, the elevator control device makes it possible to hold the car in a horizontal position.

According to another feature of the invention, the elevator control device further includes weighing units attached to ends of the multiple hoist ropes on sides of the car for detecting weights carried by the hoist ropes. In this elevator control device, a current command correction signal produced based on the detected weights output from the weighing units is added to inputs of the current controllers for the individual traction units so that the detected positions of the individual traction units coincide with each other regardless of a difference between the detected weights output from the weighing units.

In this construction, accelerations produced by the individual traction units become balanced and vibration of the car is suppressed. Since the traction units are driven in a controlled fashion to reduce inclination of the car caused by unbalanced location of passengers, the elevator control device makes it possible to hold the car in a horizontal position.

According to still another feature of the invention, the elevator control device further includes a horizontal position sensor for detecting the horizontality of the car. In this elevator control device, a current command correction signal produced based on an output of the horizontal position sensor is added to inputs of current controllers for the individual traction units so that the car is held in a horizontal position.

In this construction, accelerations produced by the individual traction units become balanced and vibration of the car is suppressed. Since the traction units are driven in a controlled fashion to reduce inclination of the car caused by unbalanced location of passengers, the elevator control device makes it possible to hold the car in a horizontal position.

According to yet another feature of the invention, the elevator control device further includes a torque distributor for generating a current command correction signal based on the current commands generated by and input from the speed controllers for the individual traction units, the torque distributor including a low-pass filter having desirable time constant characteristics. In this elevator control device, the current command correction signal generated by the torque distributor is added to inputs of the current controllers for the individual traction units so that a difference between the current commands generated by the speed controllers for the individual traction units diminishes at a desired time constant if such a difference occurs between the current commands.

The elevator control device thus constructed can suppress unwanted vibration caused by the difference between the current commands for the individual traction units.

According to the invention, the electric motor employed in each traction unit is not limited the aforementioned synchronous motor which is driven by 3-phase alternating currents supplied from PWM inverters. It should be appreciated that the present invention exerts the same advantageous effects as thus far described when applied to elevator control devices designed to control an elevator driven by a plurality of traction units employing various types of electric motors.

What is claimed is:

1. An elevator control device for controlling up-down movements of a load-carrying car by driving a plurality of traction units which haul a hoist rope interconnecting the car and a counterbalance, said elevator control device comprising:

position sensors disposed at the traction units for detecting car position by sensing positions of the individual traction units; and current supplies for supplying electric currents to the individual traction units in which each of the current supplies generates the electric current based on an input difference between a common position command for the traction units and a feedback signal derived from an output of the position sensor disposed at the corresponding traction unit.

2. The elevator control device according to claim 1, wherein each of the current supplies includes:

a position controller for generating a speed command for the corresponding traction unit based on the input difference between the common position command and the feedback signal derived from the output of the pertinent position sensor;

a speed controller for generating a current command for the corresponding traction unit based on an input difference between the speed command generated by the position controller and a feedback signal obtained by differentiating the output of the pertinent position sensor; and a current controller for supplying the electric current to the corresponding traction unit based on the current command generated by the speed controller.

3. The elevator control device according to claim 2 further comprising:

a position output converter for averaging the outputs of the position sensors;

wherein those feedback signals derived from the outputs of the position sensors which are supplied to the position controllers for the individual traction units are position signals obtained by averaging the outputs of the position sensors by the position output converter.

4. The elevator control device according to claim 2 further comprising:

a position output differential converter for averaging differentials of the outputs of the position sensors;

wherein those feedback signals obtained by differentiating the outputs of the position sensors which are supplied to the speed controllers for the individual traction units are position differential signals obtained by averaging the differentials of the outputs of the position sensors by the position output differential converter.

5. The elevator control device according to claim 2 wherein the position sensors detect the positions of the individual traction units by sensing angular positions of rotors of the traction units.

6. The elevator control device according to claim 2 wherein said position sensors are first position sensors which detect the car position by sensing angular positions of rotors of the traction units, said elevator control device further comprising:

second position sensors for detecting the car position based on angular positions of sheaves which are driven to rotate as the hoist rope runs;

wherein sensing errors of the first position sensors potentially caused by acceleration or deceleration by the traction units are compensated for by adding differences between the outputs of the first position sensors and outputs of the second position sensors to the input differences supplied to the position controllers for the individual traction units.

7. The elevator control device according to claim 2 wherein said position sensors are first position sensors which detect the car position by sensing angular positions of rotors of the traction units, said elevator control device further comprising:

a third position sensor for detecting the car position based on an angular position of a governor which are driven to rotate as a rope runs, the rope being connected between the car and the counterbalance without being acted upon by tensile forces produced by the traction units;

wherein sensing errors of the first position sensors potentially caused by acceleration or deceleration by the traction units are compensated for by adding differences between the outputs of the first position sensors and outputs of the third position sensors to the input differences supplied to the position controllers for the individual traction units.

8. The elevator control device according to claim 2 wherein said position sensors are first position sensors which detect the car position by sensing angular positions of rotors of the traction units, said elevator control device further comprising:

second position sensors for detecting the car position based on angular positions of sheaves which are driven to rotate as the hoist rope runs;

wherein sensing errors of the first position sensors potentially caused by acceleration or deceleration by the traction units are compensated for by adding differences between differentials of the outputs of the first position sensors and differentials of outputs of the second position sensors to the input differences supplied to the speed controllers for the individual traction units.

9. The elevator control device according to claim 2 wherein said position sensors are first position sensors which detect the car position by sensing angular positions of rotors of the traction units, said elevator control device further comprising:

a third position sensor for detecting the car position based on an angular position of a governor which are driven to rotate as a rope runs, the rope being connected between the car and the counterbalance without being acted upon by tensile forces produced by the traction units;

wherein sensing errors of the first position sensors potentially caused by acceleration or deceleration by the traction units are compensated for by adding differences between differentials of the outputs of the first position sensors and differentials of outputs of the third position sensors to the input differences supplied to the speed controllers for the individual traction units.

10. The elevator control device according to claim 2 wherein the car is supported by the same number of hoist ropes as the number of the traction units, and the traction units haul the individual hoist ropes.

11. The elevator control device according to claim 2 wherein the car is supported by a plurality of hoist ropes, and at least two of the hoist ropes are run side by side at least in part and the traction units drive the car by hauling parallel-running portions of the hoist ropes.

12. The elevator control device according to claim 10 further comprising:

weighing units attached to ends of the multiple hoist ropes on sides of the car for detecting weights carried by the hoist ropes;

wherein a position command correction signal produced based on the detected weights output from the weighing units is added to the input differences supplied to the position controllers for the individual traction units so that the detected positions of the individual traction units coincide with each other regardless of a difference between the detected weights output from the weighing units.

13. The elevator control device according to claim 10 further comprising:

weighing units attached to ends of the multiple hoist ropes on sides of the car for detecting weights carried by the hoist ropes;

wherein a current command correction signal produced based on the detected weights output from the weighing units is added to inputs of the current controllers for the individual traction units so that the detected positions of the individual traction units coincide with each other regardless of a difference between the detected weights output from the weighing units.

14. The elevator control device according to claim 10 further comprising:

a horizontal position sensor for detecting the horizontality of the car;

wherein a current command correction signal produced based on an output of the horizontal position sensor is added to inputs of current controllers for the individual traction units so that the car is held in a horizontal position.

15. The elevator control device according to claim 10 further comprising:

a torque distributor for generating a current command correction signal based on the current commands generated by and input from the speed controllers for the individual traction units, the torque distributor including a low-pass filter having desirable time constant characteristics;

wherein the current command correction signal generated by the torque distributor is added to inputs of the current controllers for the individual traction units so that a difference between the current commands generated by the speed controllers for the individual traction units diminishes at a desired time constant if such a difference occurs between the current commands.

* * * * *